US006282794B1

(12) United States Patent
Cho et al.

(10) Patent No.: US 6,282,794 B1
(45) Date of Patent: Sep. 4, 2001

(54) ROTARY CUTTER WITH A BLADE CARTRIDGE

(76) Inventors: Young-Keun Cho, 504-1502 Expo, Apt., 464-1 Jeonmin-dong, Yusung-ku, Daejeon (KR); Myung Seok Kim, 135-1204 Hanbit Apt., Eoen-dong, Yusung-ku, Daejeon (KR)

( * ) Notice: Subject to any disclaimer, the term of this patent is extended or adjusted under 35 U.S.C. 154(b) by 0 days.

(21) Appl. No.: 09/322,133

(22) Filed: May 27, 1999

(30) Foreign Application Priority Data

May 27, 1998 (KR) ..... 98-19319
Aug. 7, 1998 (KR) ..... 98-32179

(51) Int. Cl.[7] ..... B26B 3/06
(52) U.S. Cl. ..... 30/151; 30/292; 30/319
(58) Field of Search ..... 30/151, 292, 307, 30/319; D7/694

(56) References Cited

U.S. PATENT DOCUMENTS 5,299,355 4/1994 Boda et al. ..... 30/162
5,649,365 * 7/1997 Yang ..... 30/307 X

OTHER PUBLICATIONS

Rotary Cutter with Adjustable Safety Guard, N251–8355, © 1998 Fabri–Centers of America, Inc.
OLFA Deluxe 45mm Rotary Cutter, RTY–2/DX, Olfa Products Groups, Div. of General Housewares Corp. 1536 Beech Street, Terre Haute, Indiana 47804.
O'Lipfa ComforTouch Rotary Cutter, Model No. 15200, A.C. Marketech International, Ltd. 3822 Waldo Place, Columbus, Ohio 43220.

* cited by examiner

*Primary Examiner*—Douglas D. Watts
(74) *Attorney, Agent, or Firm*—McDonnell Boehnen Hulbert & Berghoff

(57) ABSTRACT

The present invention is directed to a cutter having a disposable blade cartridge, a grip for handling by a user, and a coupling arrangement for coupling the cartridge to the grip in such a manner to prevent undesired rotation of the cartridge with respect to the grip. The blade cartridge includes a blade, an upper cover, and a lower cover, the blade being rotatably supported therebetween. The upper cover is further provided with a locking protrusion at one end and a locking recess. The locking protrusion is inserted into a locking aperture that is carried by the grip, thereby acting against a spring-biased pusher within the aperture. The grip further carries a spring-biased locking member that mates with the locking recess of the upper cover. To attach the blade cartridge to the grip, the locking protrusion is inserted into the locking aperture, against the spring-biased pusher. The cartridge is then rotated 90° clockwise, thereby locking the protrusion in the aperture. This rotation also causes the locking member to move into engagement with the locking recess. To release the blade cartridge from the grip, a release knob that is operatively coupled to the locking member is actuated, thereby moving the member out of engagement with the recess. The blade cartridge can then be rotated 90° counterclockwise. In this position, the spring-biased pusher acts against the locking protrusion, thereby detaching the cartridge from the grip. Once the cartridge is detached, a new cartridge can be placed on the grip and the old cartridge disposed.

17 Claims, 10 Drawing Sheets

130
132
131
100
122
160
111
115
112
120
121
150
140
110
115
113
190
180

ROTARY CUTTER WITH A BLADE CARTRIDGE

The present application claims foreign priority benefits under 35 U.S.C. §119 from Korea Application Serial No. 98-19319, filed May 27, 1998, and Korea Application Serial No. 98-32179, filed Aug. 7, 1998.

FIELD OF THE INVENTION

The present invention is directed generally to a cutter for cutting material and particularly to a rotary cutter that allows users to replace a used blade quickly and easily without fear of being cut by the blade edge.

BACKGROUND OF THE INVENTION

Due to its ease of use, a rotary cutter is commonly used in place of scissors for cutting material such as fabric or paper. In general, a rotary cutter includes a head part having a rotating round blade and a grip part for a user to grip and secure the head part. Such a rotary cutter facilitates the curved or straight cutting of thin material. Although the blade of a rotary cutter can be as sharp as a razor, it easily becomes blunt from contact with other objects or wear and thus must be changed.

An example of the rotary cutter of the prior art is shown in FIGS. 1 and 2. This rotary cutter has a holder 10 having a grip part 11 for gripping by the user, a blade-holding part 12 with an elliptical hole 12*a* at the center, and a blade 20. A push button 30 with a boss 31 is provided in the blade-holding part 12. Pushing the button 30 causes the boss 31 to move along the elliptical hole 12*a* to a blade-exposing position, shown in FIG. 2 by the dotted line. The cutter is also provided with a locking means to lock the blade in the blade-exposing position and a release button 15 to release the push button 30 from the locked position. To cut material, the cutter with its blade in the blade-exposing position is pressed against the material.

The blade 20 is rotatably attached to the boss 31 by a pivot 50 and a nut 40. A wave spring 60 and a fan-shaped cover 70 are provided between the pivot 50 and the blade 20. The resistance against the rotation of the blade 20 can be regulated by varying the force applied by the nut 40 on the pivot 50.

The cutter mentioned above, however, has a number of shortcomings. First, in order to change a blunt blade, a user must disassemble the nut, the pivot, the wave spring and the cover, and reassemble them once the blade has been replaced. This procedure is time-consuming. Second, because the user must touch the blade to change it, the user is exposed to the danger of being cut by the edge of the blade. Third, new, bare blades can be easily damaged by merely being hit against an object during changing or handling. Lastly, a used, loose blade can be a safety concern after being separated from the cutter. Thus, there is a need for a rotary cutter that will meet these shortcomings of the prior art.

SUMMARY OF THE INVENTION

The present invention addresses the deficiencies of the prior art by providing a rotary cutter with a blade cartridge and a grip coupled to the cartridge for handling the cutter. The blade cartridge includes an upper cover, a lower cover, and a blade being supported therebetween. Once the blade edge becomes dull, the entire cartridge is detached from the grip and disposed. A new blade cartridge is then coupled to the grip. Thus, there is no need for a user to disassemble and then reassemble the elements of the blade cartridge in order to replace a dull blade. Further, the blade cartridge prevents the user from coming into direct contact with the blade edge while replacing a dull blade. Because the blade is housed within the upper and lower covers of the cartridge, the blade can be easily and safely replaced. In accordance with one aspect of the invention, the lower cover of the blade cartridge of the present invention is rotatable between an open position and a closed position. In the open position, the edge of the blade is exposed and the cutter can be used for cutting material such as fabric. In the closed position, the lower cover houses the blade, thereby protecting the edge of the blade when the cutter is not in use. The blade cartridge is removed from the grip of the cutter with the lower cover preferably in the closed position. Thus, the chances that the user will be cut by the edge of the blade are reduced. Further, since the lower cover protects the blade, the likelihood that the blade will be damaged during the changing process is minimized. After the blade cartridge has been detached from the grip of the cutter, the blade remains housed within the cartridge. Thus, the used blade can be safely disposed and the dangers associated with free, used blades are avoided.

In accordance with another aspect of the present invention, the blade cartridge remains firmly secured to the grip despite the application of any side forces during use. This feature is attributed to the anti-rotation mechanism provided in the coupling arrangement between the blade cartridge and the grip. In one embodiment of the present invention, the anti-rotation mechanism includes a locking recess provided on the blade cartridge and a spring-biased locking member that is carried by the grip. Once the cartridge is rotated with respect to the grip to couple the cartridge to the grip, the locking member mates with the locking recess, thereby preventing any undesired rotation between the blade cartridge and the grip.

BRIEF DESCRIPTION OF THE DRAWINGS

The invention will now be further described, by way of example only, with references to the accompanying drawings, in which.

DETAILED DESCRIPTION OF THE PRESENTLY PREFERRED EMBODIMENT(S)

Figures 1, 2:
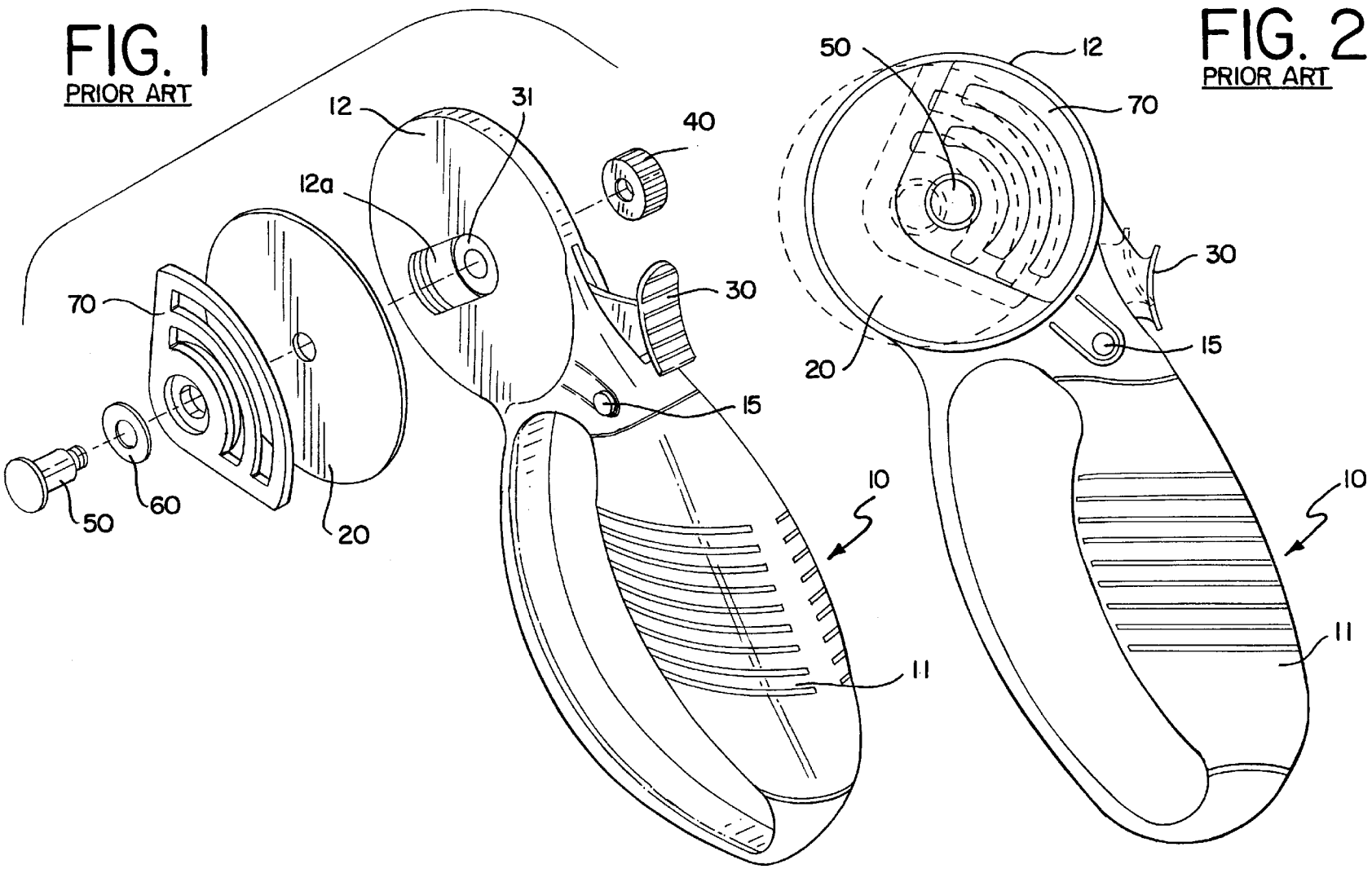
FIG. 2 PRIOR ART
FIG. 1 PRIOR ART
FIG. 1 illustrates an exploded perspective view of a prior art rotary cutter.
FIG. 2 shows the cutter of FIG. 1 with the blade exposed.
Figure 3:
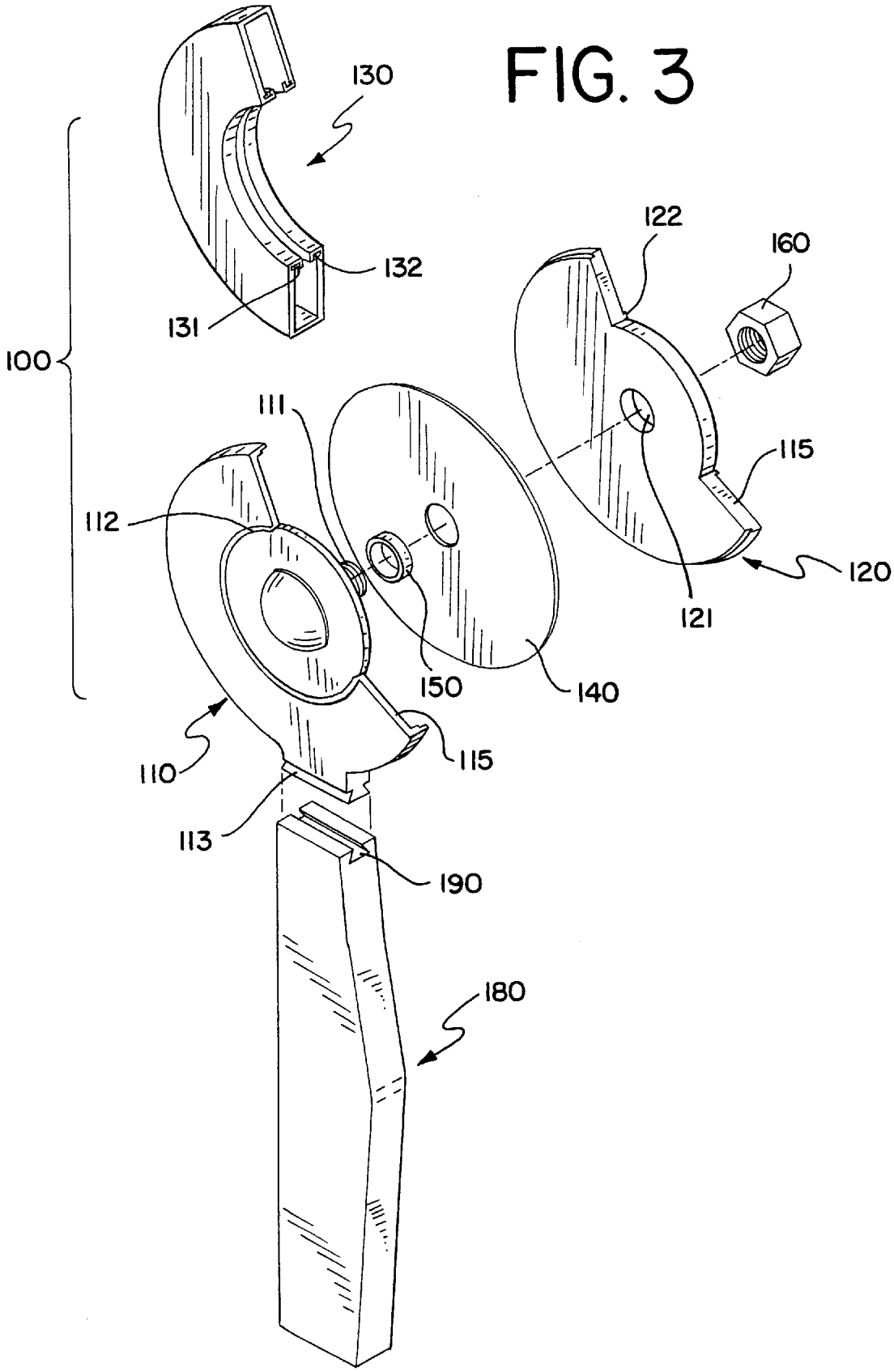
FIG. 3 illustrates an exploded perspective view of the rotary cutter with a blade cartridge in accordance with the present invention.
Figure 4:
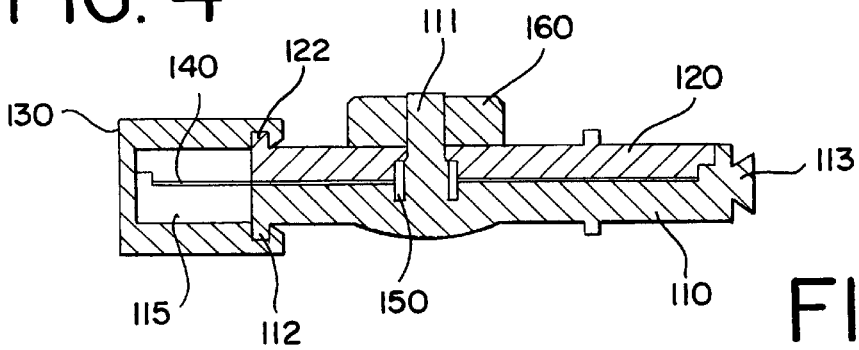
FIG. 4 shows a cross sectional view of the blade cartridge.

Referring now to the accompanying drawings, a blade cartridge 100 made in accordance with one embodiment of the present invention is shown in FIGS. 3 and 4. The cartridge 100 generally comprises a cover unit having a blade exposing section 115; a round blade 140 rotatably mounted in the cover unit and partially exposed through the blade exposing section 115; and a protective cover 130 slidably combined with the cover unit to open or close the blade exposing section 115.

The cover unit includes an upper cover 110 having a boss or shaft 111 to rotatably support the blade 140 and a lower cover 120 with an opening 121 through which the boss 111 extends. A nut 160 is screwed onto the boss 111 with the blade 140 and the lower cover 120 positioned between the upper cover 110 and the nut 160. The position of the nut 160 is adjusted along the boss to regulate the frictional resistance of the blade 140 against the upper and lower covers 110, 120. The upper and lower covers 110, 120 are preferably made of synthetic resin and thus elastically adjust to the force applied by the nut 160. It should be understood that other materials having characteristics similar to synthetic resin could also be used for the upper and lower covers. The resistance against the rotation of the blade 140 can be regulated by varying the force applied by the nut 160 on the upper and lower covers 110, 120. A sleeve 150 is further provided between the boss 111 and the blade 140 to prevent wear of the boss 111.

Guide ribs 112, 122 are formed in a circular arc shape on the outer surface of each of the upper and the lower covers 110, 120. Engaging ribs 131, 132 are formed on the protective cover 130 and slidably engage with the respective guide ribs 112, 122. Therefore, the protective cover 130 can open or close the blade exposing section 115 without slipping away from the upper and lower covers 110, 120.

Figure 5A:
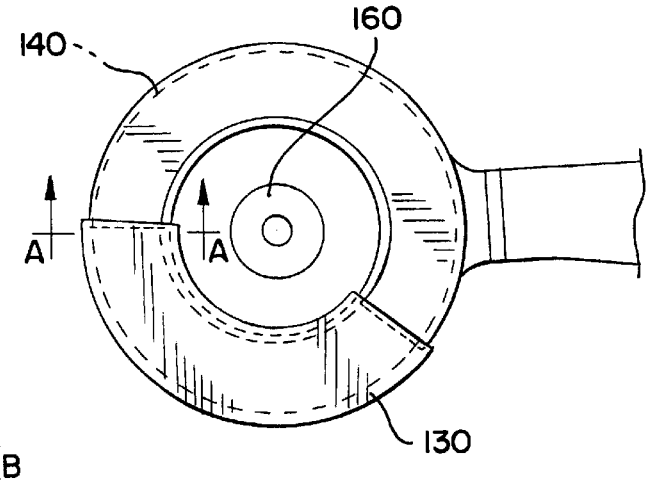
FIG. 5*a* and 5*b* are side views of the protective cover of the cartridge in its open and closed positions.
Figure 5B:
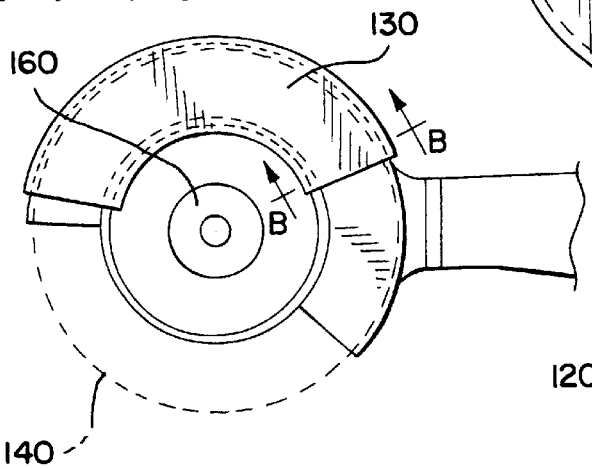
Figure 6A:
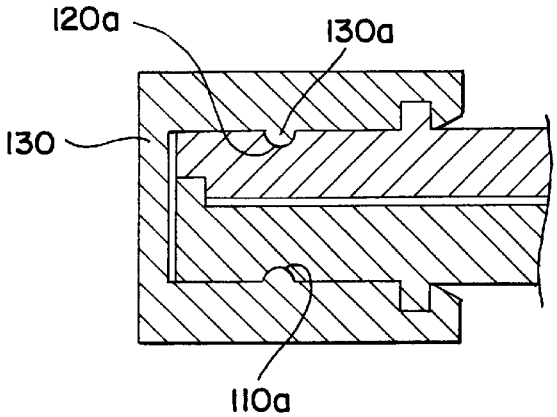
FIG. 6*a* shows a cross sectional view of the blade cartridge taken along the line A—A of FIG. 5*a*.
Figure 6B:
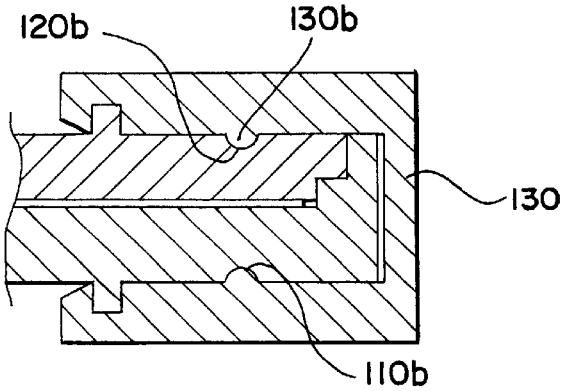
FIG. 6*b* shows a cross sectional view of the blade cartridge taken along the line B—B of FIG. 5*b*.

As illustrated in FIGS. 6*a* and 6*b*, protrusions 130*a*, 130*b* are formed on the inner surfaces of the protective cover 130 and corresponding recesses 110*a*, 110*b*, 120*a*, 120*b* are formed on the upper and lower covers 110, 120. The protrusions 130*a*, 130*b* frictionally engage the recesses 110*a*, 110*b*, 120*a*, 120*b*. As a result, the protective cover 130 can be held either in the closed position or the open position of the blade exposing section 115, as shown respectively in FIGS. 5*a* and 5*b*.

Referring back to FIG. 3, the cover unit is detachably coupled to a grip 180 by a coupling arrangement. In this embodiment, the coupling arrangement comprises a connection rib 113 formed at one end of the upper cover 110 and a groove 190 formed at one end of the grip 180 for slidably coupling with the connection rib 113. The groove has a shape that corresponds to the shape of the rib. Alternately, the rib and groove may take other shapes, as long as the rib and groove mate with one another in a similar manner as shown in FIG. 3. To separate the cover unit from the grip, the two elements are slid in opposite directions, thereby sliding connection rib 113 out of engagement with groove 190.

In the blade cartridge 100 of the embodiment of FIG. 3, the lower cover 120 is ultrasonically welded to the upper cover 110 with the blade 140 and the sleeve 150 contained therebetween. Alternate equivalent joining methods could also be used to join the upper and lower covers together. Thereafter, the protective cover 130 is placed onto the upper and lower covers. The cartridge is then coupled to the grip 180 by mating the rib 113 and the groove 190.

To use the rotary cutter to cut materials such as fabric, a user first moves the protective cover 130 to the open position, thereby exposing the blade at the blade exposing section 115. The user then presses and moves the cutter against the fabric to be cut, thereby rotating the blade 140 against the fabric. When the cutter is not in use, the protective cover is moved to close the blade exposing section 115 in order to protect the blade 140 and to prevent safety problems. To change a used blade, the whole cartridge 100 is detached from the grip 180 and replaced with a new cartridge. The old cartridge can then be disposed. Thus, the blade of the cutter can be replaced with ease and disposed in a safe manner.

Figure 7:
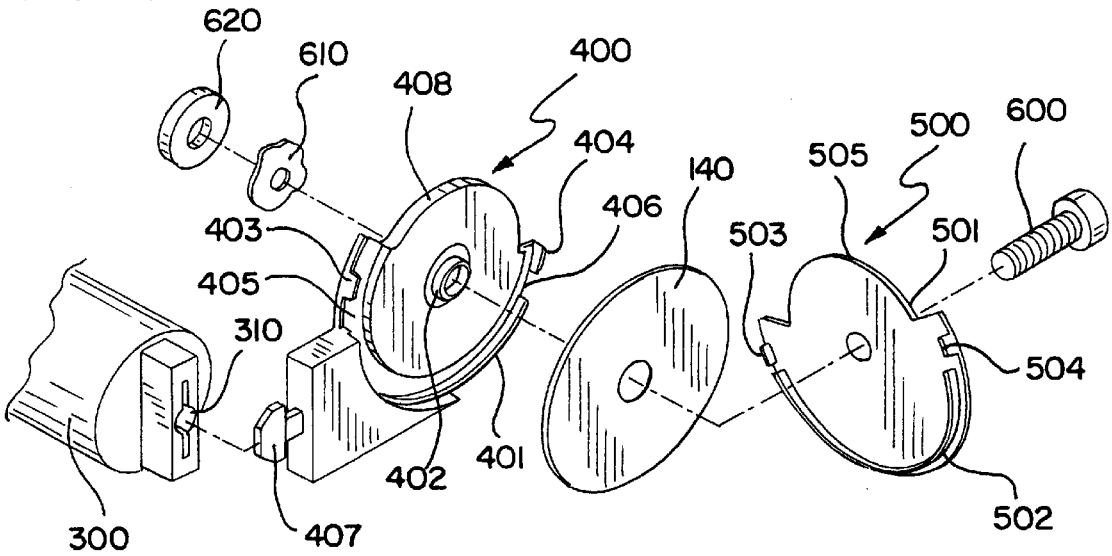
FIG. 7 is an exploded perspective view of another embodiment of a rotary cutter with a blade cartridge in accordance with the present invention.

Another embodiment of a rotary cutter in accordance with the present invention is shown in FIG. 7. The cutter of FIG. 7 includes a blade cartridge and a grip 300, the blade cartridge having an upper cover 400, a lower cover 500, and a blade 140. The upper cover 400 has a boss 402 at its center to rotatably support the blade 140, a first guiding rib 401 formed in a circular arc shape along the rim of the upper cover 400, and a first blade exposing section 408 to expose a part of the blade 140. The lower cover 500 includes an opening at its center, a control knob 501 adjacent to the opening, a second guiding rib 502 corresponding to the first guiding rib 401, and a second blade exposing section 505 corresponding to the first blade exposing section 408. The cartridge further includes a bolt 600 extending through the control knob 501 and the boss 402 to combine the upper cover 400 to the lower cover 500, and a nut 620 screwed onto the bolt 600. A wave washer 610 is also provided between the nut 620 and the upper cover 400 to regulate the resistance against the rotation of the blade 140 by varying the force applied by the nut 620.

As can be seen in FIG. 7, a first and a second locking slot 405, 406 and a first and a second stopper 403, 404 are formed at opposite ends of the first guiding rib 401 on the upper cover 400. The lower cover 500 is further provided with a locking piece 503 and a holding piece 504 formed at opposite ends of the second guiding rib 502. As described in further detail below, the locking piece 503 and the holding piece 504 interact with the stoppers 403, 404 and the slots 405, 406 to lock the blade cartridge in either an open position or a closed position.

The upper cover 400 is detachably coupled to the grip 300 by a coupling arrangement, as shown in FIG. 7. The coupling arrangement comprises a key 407 formed at one end of the upper cover 400 and a key hole 310 formed at one end of the grip 300. The key 407 is inserted into the key hole 310 and then is rotated to be locked. Once the key 407 is positioned in the key hole 310, either the blade cartridge or the grip 300 can be rotated 90° with respect to the remaining element to couple the blade cartridge and the grip together. The key 407 cannot be withdrawn from the key hole 310 without first being rotated 90° in the opposite direction.

To cut material such as paper or fabric, the user presses and moves the cutter along the material with the blade 140 exposed through the first and second blade exposing sections 408, 505. The resistance against the rotation of the blade 140 can be regulated by varying the force applied by the nut 620. The locking piece 503 of the lower cover 500 is locked at the second locking slot 406 of the upper cover 400 to keep the blade 140 exposed. While in this open position, the holding piece 504 is engaged by the first stopper 403, thereby ensuring that the locking piece 503 does not slip out of engagement with the second locking slot 406.

Figure 8A:
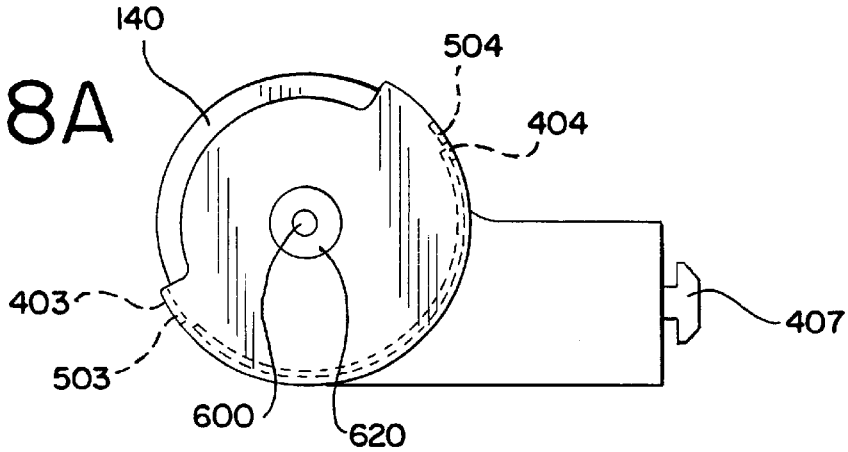
FIG. 8*a* is a plan view of the assembled cartridge in its open position.
Figure 8B:
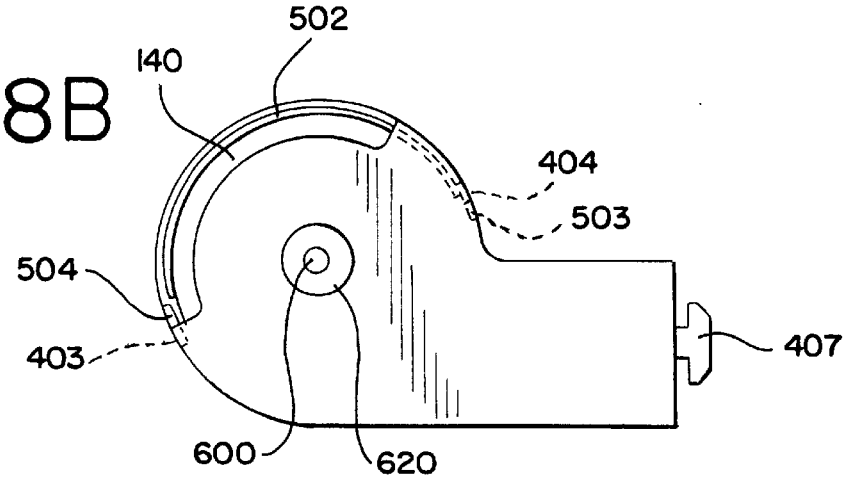
FIG. 8*b* is a plan view of the assembled cartridge in its closed position.

When the cutter is not in use, as shown in FIG. 8*b,* the control knob 501 is rotated clockwise to free the locking piece 503 from the second locking slot 406. The locking piece 503 is slid along the first guiding rib 401 until it slips into engagement with the first locking slot 405. At the same time, the holding piece 504 is moved along the first blade exposing section 408 until it is stopped by the second stopper 404. In this closed position, the blade 140 in the blade exposing part 408 is placed within the second guiding rib 502 of the lower cover 500.

To change the used blade 140, the blade cartridge is rotated 90° with respect to the grip 300. The blade cartridge is then separated from the grip 300, thereby removing the key 407 from the keyhole 310. A new blade cartridge can then be placed onto the grip. Thus, the blade of the cutter can be replaced with ease and in a safe manner.

The rotary cutters of FIGS. 3–8*b* facilitate the changing of a used blade by providing a blade cartridge that is disposable. Thus, there is no need to disassemble and reassemble the elements of the blade cartridge in order to replace the blade. Further, the blade edge is protected by the use of either the protective cover 130 of the cartridge or the second guiding rib 502 of the lower cover 500. Thus, the chances that the user will be cut by the edge of the blade or that the blade will be damaged during the changing process are reduced. In addition, because the blunt blade is contained within the cartridge after it is changed, the dangers associated with handling the blade are minimized.

Figure 10A:
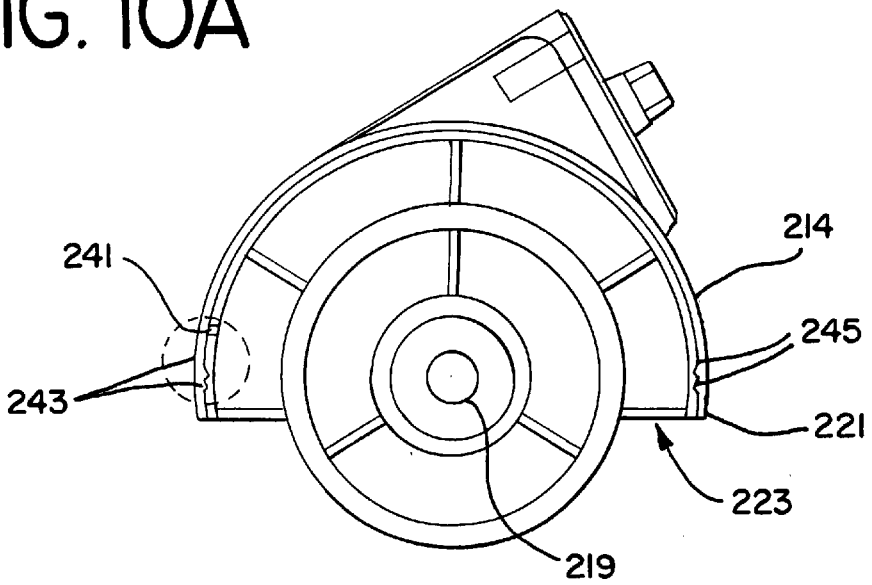
FIG. 10*a* is a side view of the upper cover of the blade cartridge of FIGS. 9*a* and 9*b*.
Figure 10B:
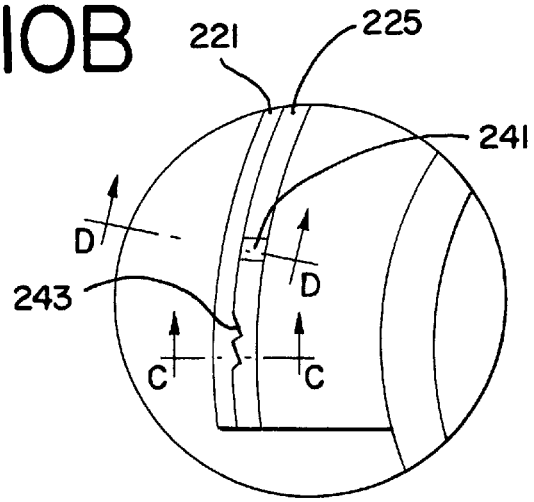
FIG. 10*b* is a detail view of the locking ribs on the upper cover of the cartridge of FIG. 10*a*.
Figure 10C:
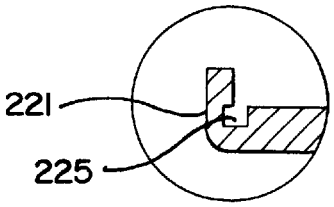
FIG. 10*c* is a cross sectional view taken along line C—C of FIG. 10*b*.
Figure 10D:
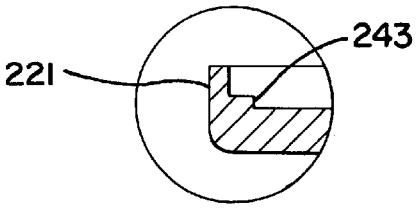
FIG. 10*d* is a cross sectional view taken along line D—D of FIG. 10*b*.
Figure 11:
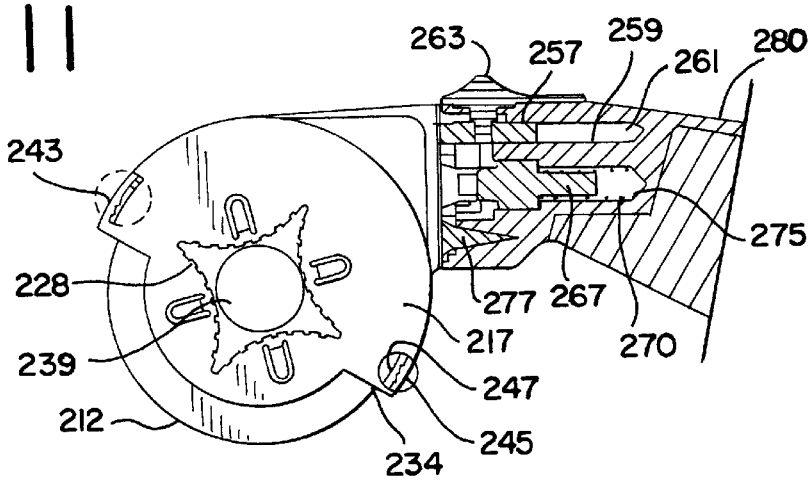
FIG. 11 is a partial cross sectional view of the assembled cutter of FIGS. 9*a* and 9*b*.
Figure 12:
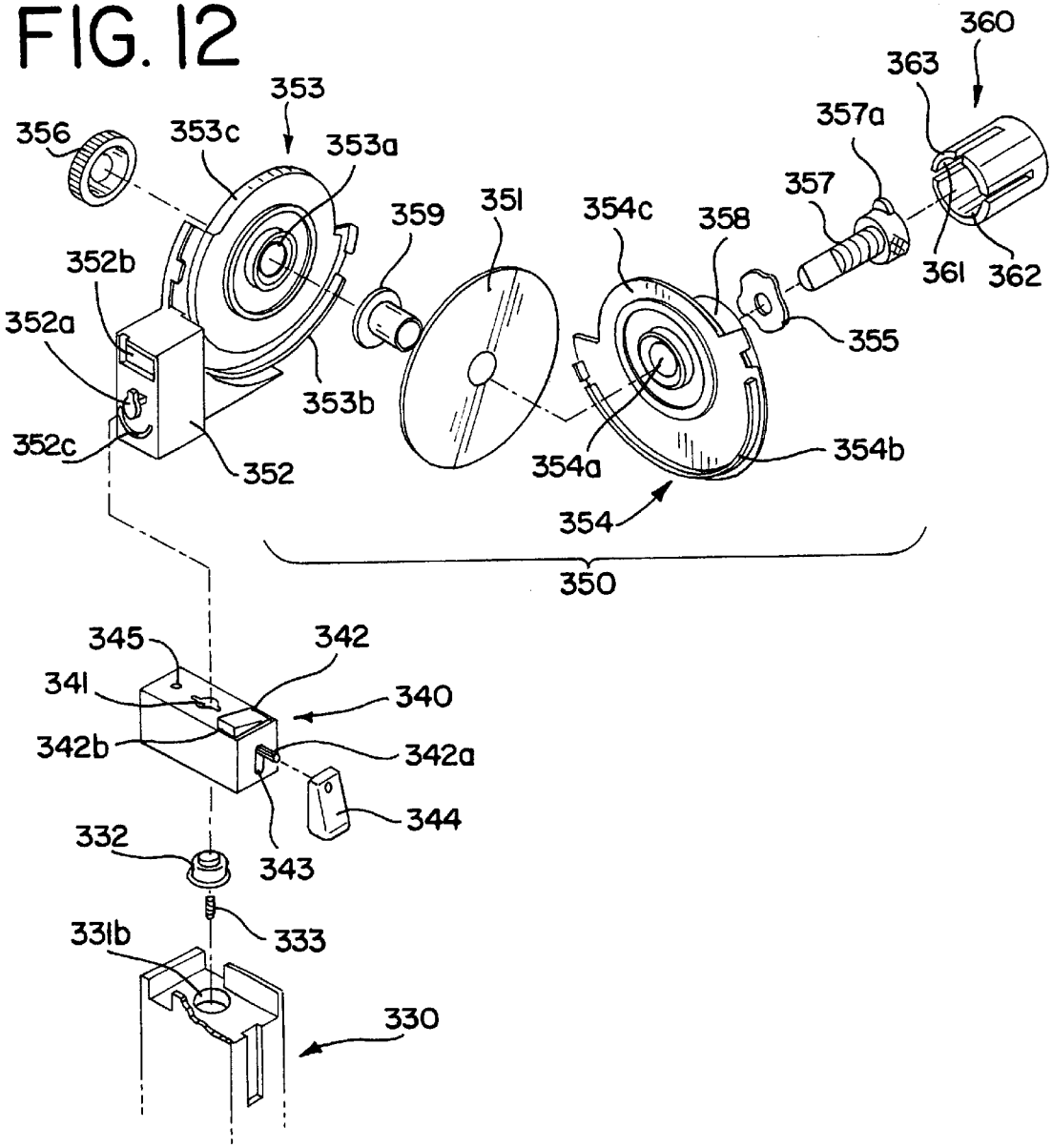
FIG. 12 shows an exploded perspective view of yet another embodiment of the blade cartridge and the rotary cutter in accordance with the present invention.

The preferred embodiment of the cutter of the present invention is shown FIGS. 9–11. Similar to the cartridges discussed above, the cartridge 210 of FIGS. 9–11 includes a blade 212, an upper cover 214, and a lower cover 217. The upper cover 214 includes a boss or shaft 219 extending from its center for rotatably supporting the blade 212, a first guiding rib 221 formed in a circular arc shape along the peripheral edge of the upper cover 214, and a first blade exposing section 223 at which a portion of the blade 212 is exposed. The upper cover 214 is further provided with a groove 225 adjacent to the first guiding rib 221. The lower cover 217 includes an opening 230 extending therethrough, a control knob 228 provided at the center of the cover, a second guiding rib 232 formed in a circular arc shape adjacent the peripheral edge of the lower cover 217, and a second blade exposing section 234 at which a portion of the blade 212 is exposed.

To hold the elements of the cartridge 210 together, the shaft 219 of the upper cover 214 extends through the opening 230 of the lower cover 217. A washer 236 is press-fitted onto the end of the shaft 219. It is the press-fit between the washer 236 and the shaft 219 that holds the elements together. The washer 236 is preferably made of metal. However, other materials having similar characteristics can also be used for the washer. The lower cover 217 is then provided with a cartridge cap 239 to enclose the inner workings of the cartridge 210. Once assembled, the lower cover 217 is rotated about the shaft 219 in order to move the cartridge 210 between the open and closed positions. During this rotational movement, the guiding rib 232 of the lower cover moves along the groove 225 of the upper cover.

As shown in FIG. 10*a,* the upper cover 214 is provided with a stopper projection 241 in the groove 225 adjacent one of the ends of the first guiding rib 221. The projection 241 engages the guiding rib 232 of the lower cover 217 to stop any further clockwise rotation of the lower cover 217 once it has been rotated to the closed position. Specifically, the projection 241 abuts the second guiding rib 232, thereby preventing further rotation of the lower cover.

The upper cover 214 is further provided with two sets of locking ribs 243, 245, a set adjacent to each end of the guiding rib 221. The lower cover 217 is also provided with a further locking rib 247 adjacent to one end of its guiding rib 232. The locking rib 247 of the lower cover 217 interacts with the locking ribs 243, 245 of the upper cover 214 to ensure that the cartridge remains in the desired position. As the lower cover 217 is rotated to the closed position, the locking ribs mate to lock the lower cover 217 in that position. Specifically, the single rib 247 of the lower cover 217 is placed between the locking ribs 243 of the upper body 214. As the lower cover 217 is rotated back to the open position, the locking rib 247 of the lower cover 217 engages with the ribs 245 to lock the lower cover 217 in that position. This locking arrangement can take alternate equivalent forms. For example, instead of locking ribs, mating protrusions could be employed to lock the lower cover in the desired position.

The elements of the blade cartridge 210 of FIGS. 9–11 are preferably injection molded of acrylonitrile-butadiene styrene ("ABS"), with the exception of the blade 212. With respect to the grip 280, it is constructed of polyvinyl chloride ("PVC"). It should be understood that the blade cartridge or the grip can be made using other materials having similar characteristics.

The preferred embodiment of the blade cartridge 210 of FIGS. 9–11 provides a number of advantages over the prior art. Because it is disposable, the elements of the blade cartridge do not have to be disassembled and reassembled in order to replace the blade. The cartridge 210 is also provided with a locking rib arrangement and a stopper projection to ensure that the lower cover remains in the closed position when desired. When the cartridge is separated from the grip, the lower cover is preferably in the closed position. Consequently, the blade edge remains protected by the lower cover, thereby avoiding injury to the user. Further, the new cartridge is placed on the grip preferably in the closed position. Thus, the damage to the blade edge is avoided.

A further embodiment of the rotary cutter of the present invention is shown in FIGS. 12–18. The rotary cutter 300 generally comprises a blade cartridge 350 rotatably supporting a blade 351, a coupling arrangement 340, 352, and a grip 330 for handling by the user.

As can be seen in FIGS. 12–15, the blade cartridge 350 includes an upper cover 353 and a lower cover 354 that together rotatably support the blade 351. The upper cover 353 has a first opening 353*a* at its center and a first edge exposing portion 353*c* for exposing a part of the blade 351. The upper cover 353 further includes a locking body 352 extending from its one end. The lower cover 354 has a second opening 354*a* and a second edge exposing portion 354*c* for exposing a part of the blade 351. First and second guide ribs 353*b*, 354*b* are formed respectively along each peripheral edge of the upper cover 353 and the lower cover 354. The guide ribs, however, are not formed along the first and second edge exposing portions 353*c*, 354*c*.

Figure 15:
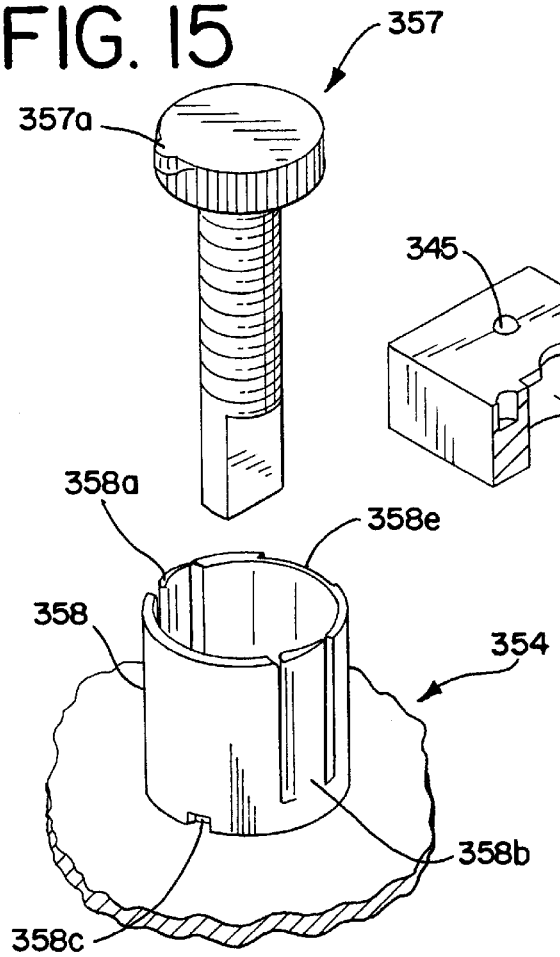
FIG. 15 is a perspective view of the coupling arrangement for the blade cartridge of FIG. 12.

Referring to FIG. 15, a cylindrical controlling boss 358 is formed at an outer surface of the lower cover 354. The boss 358 is coaxially aligned with the second opening 354*a*. Elastic strips 358*a*, 358*b* are provided in the wall of the controlling boss 358.

Figure 13:
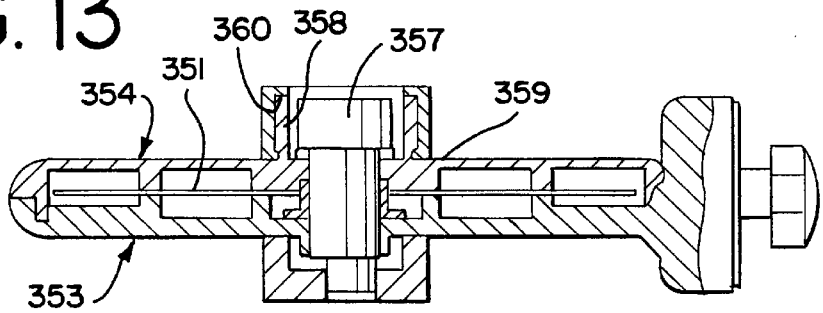
FIG. 13 shows a side view of the assembled blade cartridge of the embodiment of FIG. 12.
Figure 14A:
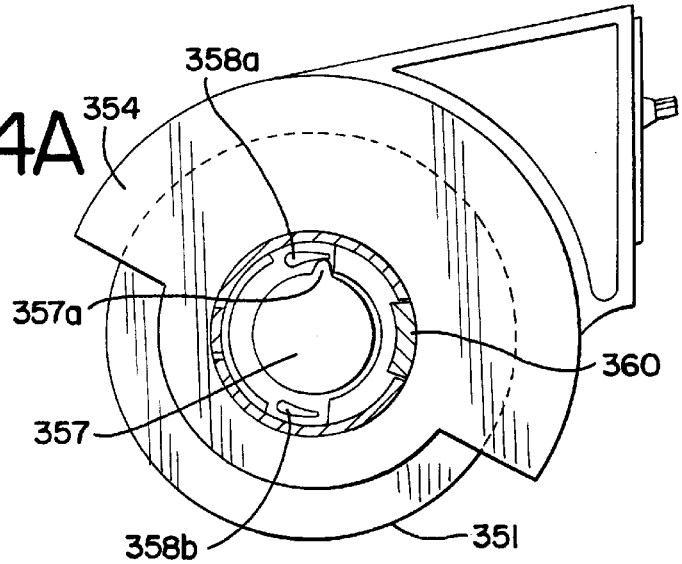
FIGS. 14*a* and 14*b* show the operation of the blade cartridge of FIG. 12.
Figure 14B:
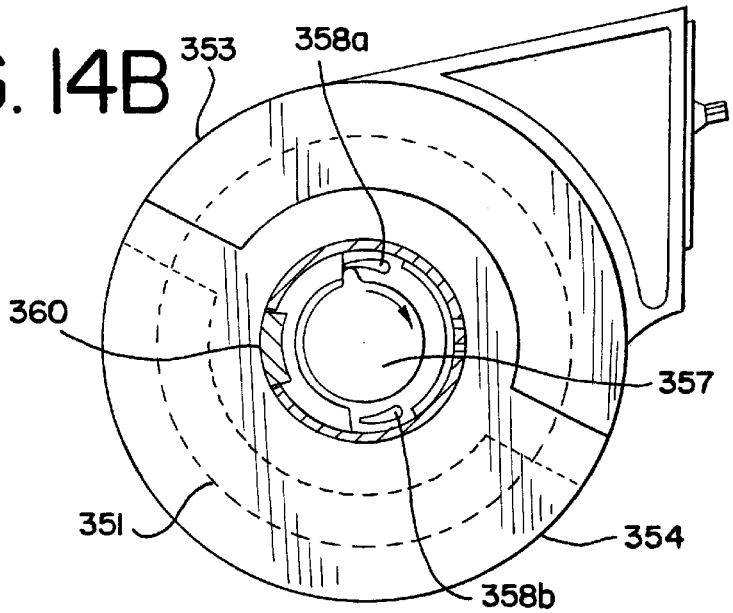

The upper and lower covers coupled together in the following manner. As shown in FIGS. 13 and 15, a bolt 357 is inserted through the first and second openings 353*a*, 354*b*. The bolt 357 has a stopper 357*a* at the side of its head that can be elastically locked by elastic strips 358*a* and 358*b*. A wave spring 355 is provided between the head of the bolt 357 and the lower cover 354. The free end of the bolt is provided with a nut 356. A sleeve 359 is further provided between the upper cover 353 and the lower cover 354, to which the blade 351 is rotatably connected. The resistance against the rotation of the blade 351 can be regulated by changing the contact force between the upper cover 353 and the lower cover 354. Adjusting the nut 356 causes the wave washer to correspondingly change the contact force between the covers.

A protective cap 360 is further provided for protecting the elastic strips 358*a*, 358*b* during the rotation of the lower cover 354. As can be seen in FIG. 13, the cap 360 is placed over the controlling boss 358. The cap 360 is provided with jaws 361, 362 that lock into locking apertures 358*c*, 358*d*, which are formed at the lower end of the outer surface of the controlling boss 358. This interaction between the jaws and the locking apertures secures the connection between the protective cap 360 and the controlling boss 358. To further ensure this connection, a longitudinal linking groove 358*e* is provided on the outer surface of the controlling boss 358. The groove 358*e* mates with a rib 363 formed on the inner surface of the protective cap 360.

The elastic strips 358*a*, 358*b* of the controlling boss 358 interact with the stopper 357*a* of the bolt 357 to lock the blade cartridge in either the open or closed position. This interaction ensures that the cartridge remains in the desired position. Thus, the chances of the blade cartridge being inadvertently placed in the open position are reduced.

The cutter of FIGS. 12–18 further comprises the preferred embodiment for an arrangement for coupling the blade cartridge to the grip, the coupling arrangement including an anti-rotation mechanism for preventing the undesired rotation of the cartridge with respect to the grip. Referring to FIGS. 12 and 16–18, the blade cartridge includes a locker body 352 with a locking protrusion 352*a* extending therefrom and a guiding groove 352*c*. The grip includes a locking block 340 having a locking aperture 341 and a guide ball 345. The aperture 341 has a shape that corresponds to the shape of the protrusion 352*a*. Alternately, the protrusion and the aperture could take shapes other than that depicted in the figures, provided that the protrusion and the aperture mate in a similar manner.

Figure 16:
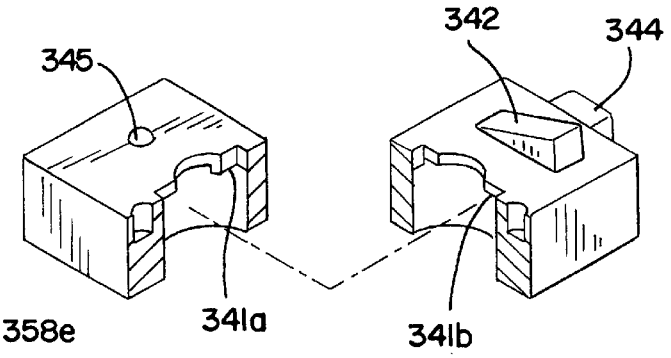
FIG. 16 is a perspective view showing the inside of the locking block of the cutter of FIG. 12.

The anti-rotation mechanism includes steps 341*a*, 341*b* formed along each edge of the locking aperture 341 on the inner surface. As can be seen in FIG. 16, the steps are located at opposite ends of the aperture 341. When the locking protrusion 352*a* is inserted into the locking aperture 341 and rotated, the steps 341*a*, 341*b* engage the protrusion and prevent rotation beyond 90°. Each edge of the aperture 341 may further be provided with a slanted face on the inner surface to initially assist in the rotation of the protrusion 352*a* along the inner surface of the aperture 341. The slanted face may be provided along each edge of the aperture 341, opposite from the respective step. Also during this insertion and rotation, the guide ball 345 is guided by guiding groove 352*c* to assist this rotational movement.

The anti-rotation mechanism of the coupling arrangement further includes a locking recess 352*b* on the locker body 352 and a locking member 342 extending through an aperture 342*b* on the grip 330. As the locking protrusion 352*a* is inserted into the locking aperture 341 and rotated, the locking member 342 engages the locking recess 352*b*. The engagement between the locking member 342 and the locking recess 352*b* prevents counterclockwise rotation of the blade cartridge 350 with respect to the grip 330.

The anti-rotation mechanism of the coupling arrangement is further provided with a first spring 343 and a releasing knob 344. The first spring 343 is embedded in the locking block 340 to bias the locking member 342 outwardly. The releasing knob 344 is provided along the side of the locking block 340 and is linked to the locking member 342 by a pin 342*a*. When actuated, the releasing knob 344 slidingly moves along the outer surface of the locking block 340 and the grip 330, and against the action of the spring 343 to move the locking member 342 out of engagement with the locking recess 352 and into the locking block 340.

Figure 17:
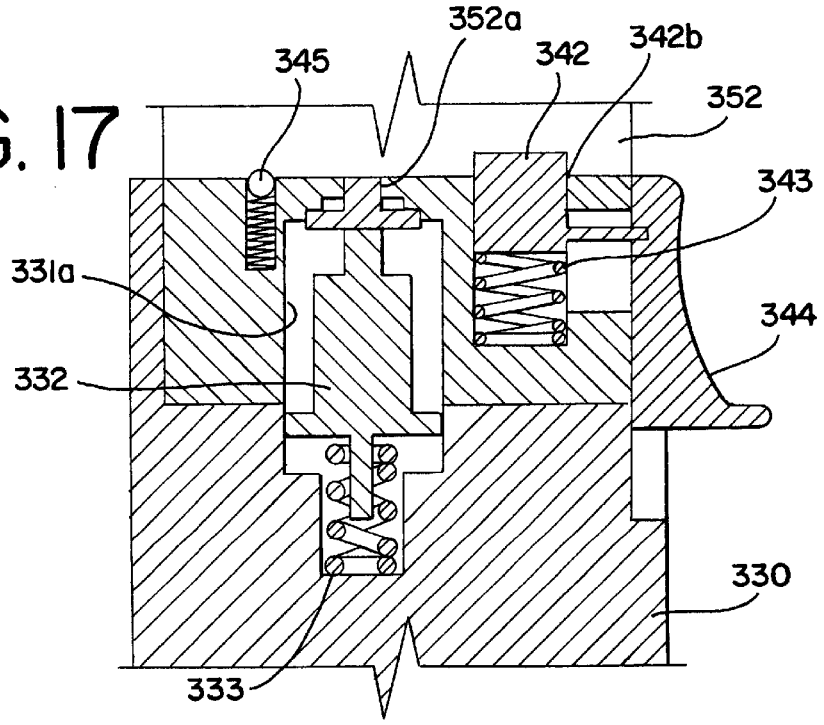
FIG. 17 is a cross sectional view of the locking block and the grip before being coupled with the cartridge.

As can be seen from FIG. 17, a second spring 333 and a pusher 332 are housed between an internal passageway 331*a* of the locking block 340 and a second passageway 331*b* of the grip 330. The pusher 332 is biased by the second spring 333. Upon insertion of the locking protrusion 352*a* into the locking aperture 341, the locking protrusion 352*a* closely contacts the inner surface of the locking aperture 341. This contact prevents any swaying of the blade cartridge 350 due to the difference between the depth of the locking aperture 341 and the length of the neck of the locking protrusion 352*a*. Further, because the locking protrusion 352*a* is always biased by the pusher 332 in the releasing direction, the locking protrusion 352*a* is easily detachable from the locking aperture 341.

To use the cutter, the blade cartridge 350 is locked to the grip 330 through the locking block 340. When the first and second edge exposing portions 353*c*, 354*c* of the upper cover 353 and lower cover 354 are aligned, the cartridge is in the open position and a portion of the blade 351 is exposed. To place the cartridge in the closed position, the lower cover 354 is rotated clockwise via the protective cap 360, to the position shown in FIG. 14*b*. In the closed position, the blade 351 is protectively positioned inside the lower cover 354 and the second guide rib 354*b*. The interaction of the elastic strips 358*a*, 358*b* of the controlling boss 358 with the stopper 357*a* of the bolt 357 ensures that the cartridge remains in the desired position.

Figure 18A:
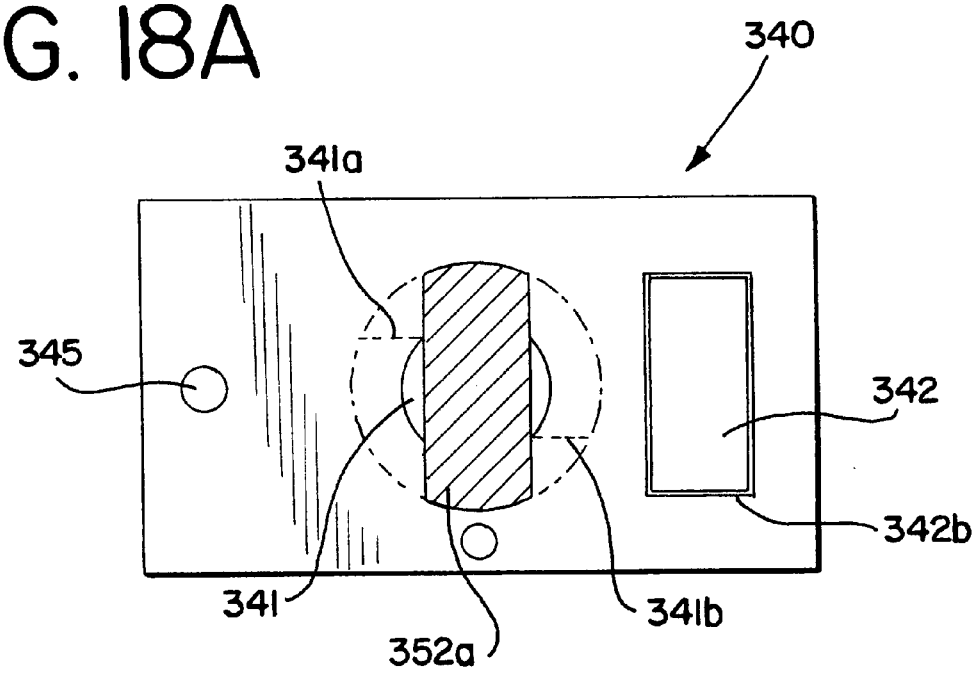
FIGS. 18*a* and 18*b* show the interaction between the locking block and the locking protrusion.
Figure 18B:
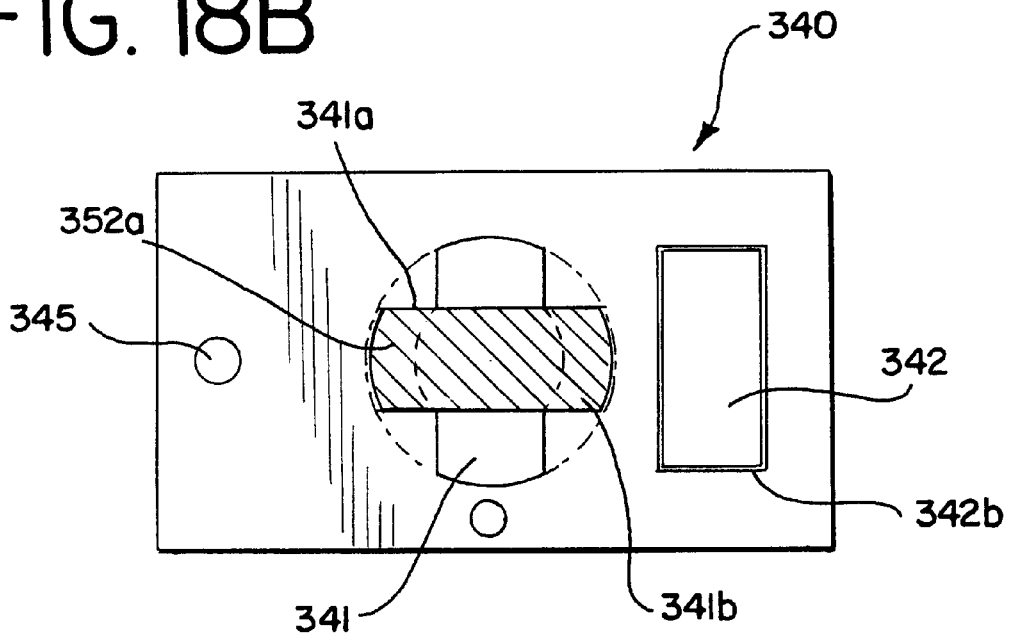

To secure the blade cartridge 350 to the locking block 340, the locking protrusion 352*a* is inserted into the locking aperture 341 as shown in FIG. 18*a*. While being inserted, the locking protrusion 352*a* acts on the pusher 332 against the action of the second spring 333. Once the protrusion 352*a* is inserted, the blade cartridge 350 is rotated 90° clockwise to the position shown in FIG. 10*b*. The blade cartridge 350 can rotate no more than 90° because of the presence of the steps

341*a,* 341*b.* At the same time, the locking member 342 is biased into engagement with the locking recess 352*b,* thereby preventing counterclockwise rotation of the blade cartridge 350. As a result, the blade cartridge 350 is firmly coupled to the grip and undesired rotation is avoided.

To release the blade cartridge 350 from the locking block 340, a user pushes down the releasing knob 344 against the bias of spring 343 to move the locking member 342 out of engagement with the locking recess 352*b* and into the locking block 340. Thereafter, the blade cartridge 350 can be rotated 90° counterclockwise and detached from the grip. As a result of the force of the spring 333, the pusher 332 pushes the protrusion 352*a* away from the grip once the cartridge is rotated 90° counterclockwise.

Figures 9A, 9B:
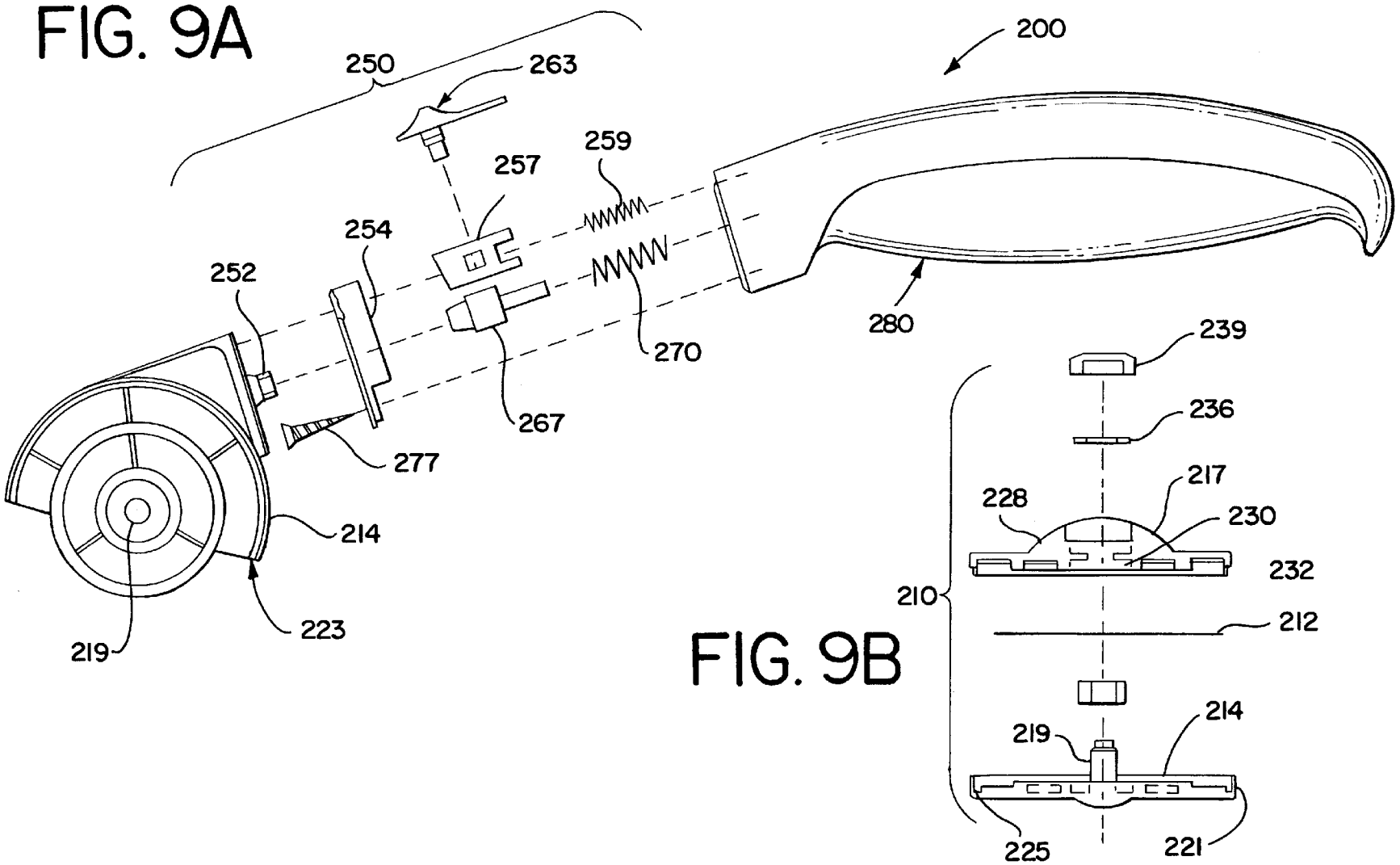
FIGS. 9*a* and 9*b* are exploded views of another embodiment of a rotary cutter with a blade cartridge in accordance with the present invention.

The rotary cutter depicted in FIGS. 9–11 includes a simplified version of the preferred embodiment of the coupling arrangement shown in FIGS. 12 and 16–18. The coupling arrangement 250 is similar to that of the embodiment of FIGS. 12–18 and includes a locking protrusion 252, a locking recess (not shown), a spring-biased pusher 267, a spring 270, a spring-biased locking member 257, a spring 259, and a releasing knob 263. Instead of a locking block, however, the embodiment of FIGS. 9–11 is provided with a locking plate 254. Although the plate 254 includes apertures to accommodate the locking protrusion and the locking member, it does not house the spring-biased pusher 267, 270 or the spring-biased locking member 257, 259. Instead, the grip 280 houses both the spring-biased pusher 267, 270 and the spring-biased locking member 257, 259. This arrangement is depicted in FIG. 11. As can be seen from FIGS. 9*a* and 11, the locking plate 254 is attached to the grip 280 via a screw 277. It should be understood, however, alternate equivalent means could be used to attach the plate to the grip.

The coupling arrangement with the anti-rotation mechanism of the rotary cutters of FIGS. 9–18 avoids the inadvertent separation of the blade cartridge from the grip and prevents any undesired rotation of the blade cartridge due to the application of force during use. For example, the cartridge cannot slip out of engagement with the grip during use. Additionally, the blade cartridge is prevented from being inadvertently rotated 90° counterclockwise with respect to the grip and out the engagement with the grip. Inadvertent separation or undesired rotation can result in imperfect cutting and possibly wasted material. In the present invention, to separate the cartridge from the grip, a user must first actuate the push button to release the locking member from the locking recess and then rotate the cartridge with respect to the grip. The coupling arrangement of FIGS. 9–18 avoids defective cutting caused by the undesired movement of the blade cartridge during use while still enabling the blade cartridge to be replaced with ease and in a safe manner.

It should be understood that various changes and modifications to the preferred embodiments described herein will be apparent to those skilled in the art. For example, although a particular spring biased locking member and releasing knob is described above, one skilled in the art could devise alternative locking members upon reviewing this detailed description. Such changes and modifications can be made without departing from the spirit and scope of the present invention and without diminishing its attendant advantages. It is therefore intended that such changes and modifications be covered by the appended claims.

What is claimed is:

1. A rotary cutter comprising:

a blade cartridge including:

an upper cover with a shaft extending therefrom for rotatably supporting a blade;

a lower cover having an opening through which the shaft extends, the lower cover capable of rotational movement with respect to the upper cover; and a blade provided between the upper and lower covers, the blade being supported on the shaft; and a grip coupled to the blade cartridge via a coupling arrangement, wherein the blade cartridge is detachable from the grip and disposable.

2. The rotary cutter of claim 1 wherein each of the upper and lower covers is provided with a blade exposing section at which a portion of the blade is exposed.

3. The rotary cutter of claim 2 wherein the lower cover is moveable between an open position in which the blade is exposed and a closed position in which the blade is not exposed.

4. The rotary cutter of claim 1 wherein each of the upper and lower covers is provided with a guiding rib adjacent to its periphery.

5. The rotary cutter of claim 1 wherein the lower cover is further provided with a control knob adjacent to the opening for rotating the lower cover.

6. The rotary cutter of claim 5 wherein a washer is provided within the control knob for mating with a distal end of the shaft.

7. The rotary cutter of claim 3 wherein the upper cover is provided with locking ribs that interact with a locking rib provided on the lower cover to lock the lower cover in either the open or closed position.

8. A blade cartridge comprising;

a blade;

an upper cover having a shaft formed at its center for rotatably supporting the blade, a first guiding rib formed adjacent the periphery of the upper cover, and a first blade exposing section at which a portion of the blade is exposed;

a lower cover having a central opening through which the shaft extends, a second guiding rib formed adjacent the periphery of the lower cover, and a second blade exposing section at which a portion of the blade is exposed, the upper and lower covers being capable of rotational movement with respect to one another, wherein the blade cartridge is disposable.

9. The blade cartridge of claim 8 wherein the upper cover is provided with a coupling arrangement for coupling the cartridge with a cutter grip so that undesired rotation between the cartridge and the cutter grip is prevented.

10. The blade cartridge of claim 9 wherein the coupling arrangement includes a locking protrusion extending therefrom for coupling with a locking aperture of a cutter grip.

11. The blade cartridge of claim 9 wherein the coupling arrangement includes a locking recess for mating with a locking member of a cutter grip.

12. The blade cartridge of claim 8 wherein the upper body is provided with a stopper projection adjacent the first guiding rib for preventing the lower cover from being rotated out of a closed position.

13. The blade cartridge of claim 12 wherein the first guiding rib is provided along the periphery of the upper body, the upper body further comprising a groove provided adjacent to the first guiding rib, the stopper projection being provided in the groove.

14. A rotary cutter comprising:

a blade cartridge for housing a blade, the blade being capable of rotational movement;

a grip for allowing the user to handle the cutter; and a coupling arrangement for coupling the blade cartridge and the grip so that any undesired rotation of the blade cartridge with respect to the grip is prevented, the coupling arrangement further comprises a locking body provided at one end of the blade cartridge, the locking body including a locking protrusion extending therefrom;

a locking aperture defined on the grip and having a shape complimentary to the locking protrusion; and a spring-biased pusher partially accommodated within the aperture, wherein the locking protrusion acts against the spring-biased pusher during insertion into the locking aperture.

15. The rotary cutter of claim 14 wherein the locking aperture includes steps that limit the rotation of the locking protrusion after the protrusion has been inserted into the aperture and rotated a certain degree with respect to the grip.

16. The rotary cutter of claim 15 wherein the locking body further includes a locking recess for engagement with a locking member of the grip.

17. The rotary cutter of claim 16 wherein the coupling arrangement further comprises a spring-biased locking member carried on the grip, the locking member engaging the locking recess to prevent undesired rotation of the cartridge after the protrusion has been inserted into the aperture and rotated a certain degree with respect to the grip.

* * * * *